US006306010B1

(12) United States Patent
West et al.

(10) Patent No.: US 6,306,010 B1
(45) Date of Patent: Oct. 23, 2001

(54) METHOD OF FORMING A HOLE IN A GLASS REFLECTOR

(75) Inventors: Roger West, Gervais; Brion Ponnay, Milwaukie, both of OR (US)

(73) Assignee: Industrial Gasket, Inc., Wilsonville, OR (US)

( * ) Notice: Subject to any disclaimer, the term of this patent is extended or adjusted under 35 U.S.C. 154(b) by 0 days.

(21) Appl. No.: 09/427,478

(22) Filed: Oct. 26, 1999

(51) Int. Cl.[7] ..... B24B 1/00
(52) U.S. Cl. ..... 451/36; 451/40; 451/41
(58) Field of Search ..... 451/36, 41, 40, 451/39

(56) References Cited

U.S. PATENT DOCUMENTS 4,053,759 10/1977 Wilkinson .
4,703,591 * 11/1987 Herrington et al. ..... 451/40
4,711,056 * 12/1987 Herrington et al. ..... 451/40
4,955,164 * 9/1990 Hashish et al. ..... 45/40
5,092,744 3/1992 Boers et al. .
5,273,405 12/1993 Chalmers et al. .
5,700,181 * 12/1997 Hashish et al. ..... 451/40
5,851,139 12/1998 Xu .
6,120,351 * 9/2000 Zeng ..... 451/28

* cited by examiner

*Primary Examiner*—Joseph J. Hail, III
*Assistant Examiner*—Daniel Shanley
(74) *Attorney, Agent, or Firm*—Kolisch Hartwell Dickinson McCormack & Heuser

(57) ABSTRACT

A method for cutting a glass reflector and a glass reflector produced by a cutting process. The method typically includes forming a fluid jet by ejecting a mixture of fluid and abrasive at an initial pressure, creating a pierce hole in the glass reflector with the fluid jet at the initial pressure, and cutting a ventilation hole in the glass reflector by moving the fluid jet from the pierce hole along a cutting path. The method may also include, after cutting the pierce hole and before cutting the ventilation hole, raising the pressure of the fluid jet from the initial pressure to an increased pressure.

28 Claims, 8 Drawing Sheets

METHOD OF FORMING A HOLE IN A GLASS REFLECTOR

TECHNICAL FIELD

The present invention relates generally to glass reflectors, and more particularly to forming holes in glass reflectors.

BACKGROUND OF THE INVENTION

A recent rise in multimedia computer applications has increased the demand for compact projectors that are powerful enough to display brightly computer-generated presentations to large groups of people, yet portable enough to be carried easily from venue to venue. These projectors typically use a lamp, mounted within a mirrored parabolic reflector, to generate a bright beam of light. In the past, these reflectors tended to be metal, however, recently glass reflectors have been preferred due to the insulating properties of glass.

As the size of these projectors has decreased, and the intensity of the projector lamps increased, problems have occurred with heat dissipation from the lamps. Where heat is not dissipated sufficiently, lamps may run at higher than intended operating temperatures, which may cause the lamps to burn out prematurely, or possibly explode. In addition, temperatures within the projector may rise and cause surrounding components to melt or be otherwise damaged by the heat, possibly resulting in a catastrophic failure of the projector.

One solution to this overheating problem for projectors with metal reflectors is to position holes within the reflector to allow cooling air from an associated cooling fan to circulate through the reflector and draw heat away from the lamp, as shown in U.S. Pat. No. 4,053,759. Because the reflector of U.S. Pat. No. 4,053,759 is metal, it would have been possible to form the holes disclosed therein using conventional drilling, sawing, grinding, and/or punching techniques.

However, no suitable technique exists for cutting a ventilation hole in a glass reflector. Molded glass reflectors are more fragile than metal reflectors, and easily fracture or shatter when machined using conventional drilling, sawing, grinding, and punching methods.

An example of another cutting device, the water jet cutting machine, is disclosed in U.S. Pat. No. 5,273,405, the disclosure of which is herein incorporated by reference. A typical water jet cutting machine, such as the machine described in U.S. Pat. No. 5,273,405, is designed to produce a water jet at between 25,000 psi and 100,000 psi. At these high pressures, the water jet is unable to pierce a hole in the middle of a surface of a molded glass reflector without frequently fracturing the reflector upon impact of the water jet with the reflector surface.

Fracture rates of about 10% are commonly experienced at 25,000 psi, requiring about 10% of the reflectors to be discarded. Molded glass reflectors are expensive components, and this high discard rate renders current water jet cutting methods commercially infeasible. In addition, current water jet cutting methods may damage those reflectors that do not visibly break by producing tiny stress fractures from the impact of the high pressure water jet, which negatively affect the structural integrity of the reflector. Therefore, current water jet cutting methods are inadequate for glass reflectors.

To reduce the problems associated with dissipating heat from projector lamps, it would be desirable to provide a cutting method capable of producing a ventilation hole in a glass reflector.

SUMMARY OF THE INVENTION

A method for cutting a glass reflector and a glass reflector produced by a cutting process are provided. The method typically includes forming a fluid jet by ejecting a mixture of fluid and abrasive at an initial pressure, creating a pierce hole in the glass reflector with the fluid jet at the initial pressure, and cutting a ventilation hole in the glass reflector by moving the fluid jet from the pierce hole along a cutting path. The method may also include, after creating the pierce hole and before cutting the ventilation hole, raising the pressure of the fluid jet from the initial pressure to an increased pressure. Typically, the initial pressure is less than about 10,000 psi and the increased pressure is greater than about 25,000 psi. Cutting the ventilation hole may include cutting along a circuitous ventilation-hole cutting path. Creating the pierce hole may include penetrating a wall of the glass reflector with the fluid jet to form a thru-hole, and also may include enlarging the thru-hole by cutting along a circuitous pierce-hole cutting path. The method also may include mounting the glass reflector in a jig at an angle relative to a longitudinal axis of the fluid jet.

The glass reflector typically is formed by a process including the steps of forming a fluid jet by ejecting a mixture of fluid and abrasive at an initial pressure, cutting a first hole in the glass reflector with the fluid jet at the initial pressure, raising the pressure of the fluid jet from the initial pressure to an increased pressure, and cutting a second hole in the glass reflector by moving the fluid jet from the first hole along a circuitous cutting path.

DETAILED DESCRIPTION AND BEST MODE FOR CARRYING OUT THE INVENTION

Figure 4:
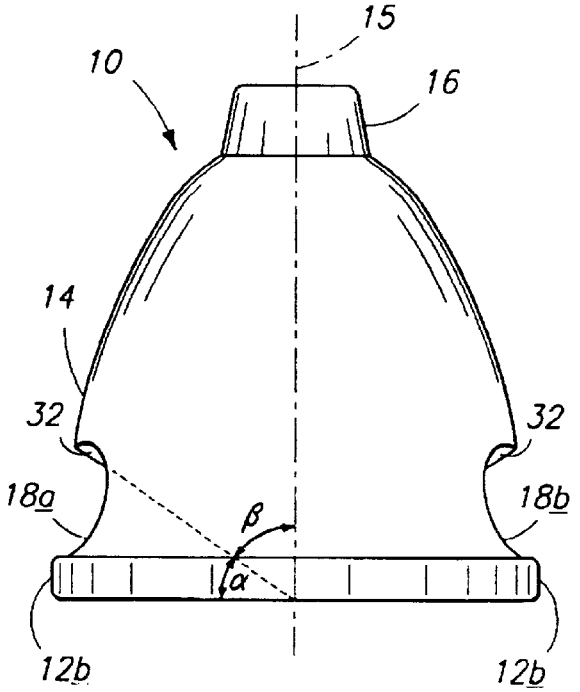
FIG. 4 is a side view of the reflector of FIG. 1.
Figure 5:
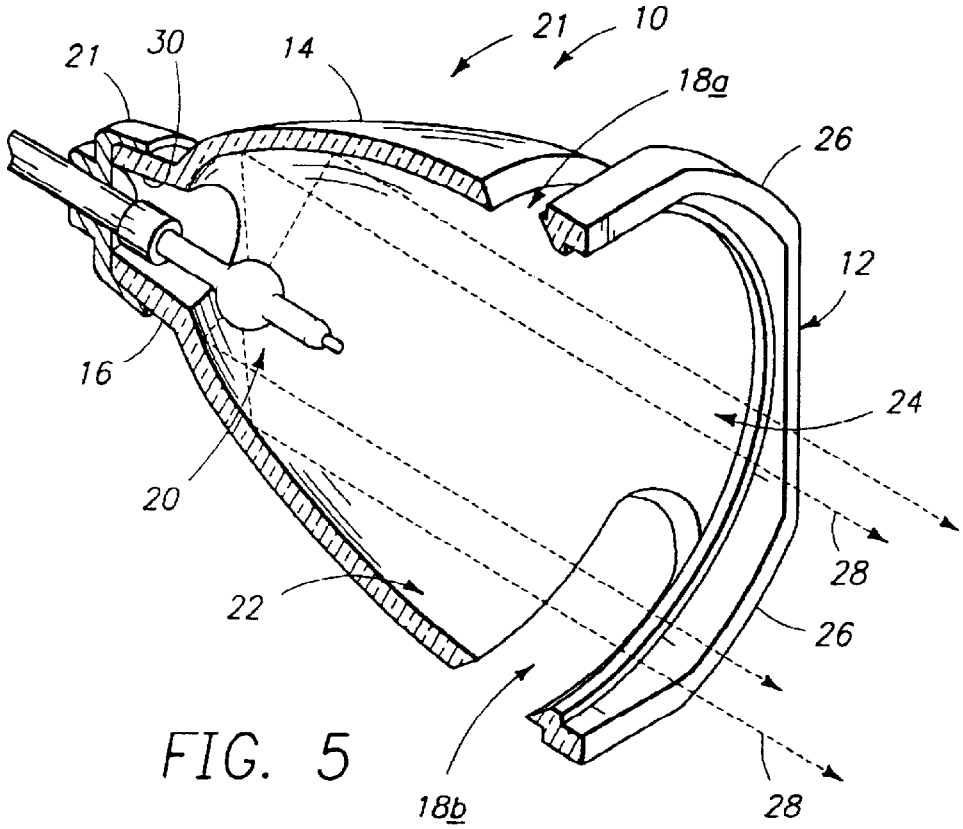
FIG. 5 is a cutaway isometric view of a reflector cut according to an embodiment of the present invention, with a lamp installed.

Referring initially to FIGS. 1–4, a reflector cut according to the present invention is shown generally at 10. Reflector 10 includes a flange 12, an enclosure 14 extending upward from flange 12, a neck 16 positioned adjacent an upward end of enclosure 14, and a pair of ventilation holes 18*a* and 18*b* cut into opposite portions of a wall of enclosure 14. As shown in FIG. 5, a lamp 20 may be installed in reflector 10 to form a lamp assembly 21. Light rays emitted backwards and to the sides by lamp 20 are reflected off of an interior surface 22 of the reflector and emitted through opening 24 of the reflector, thereby forming a light beam projecting out opening 24 of the reflector.

Flange 12 is used to attach the reflector 10 to an interior housing in a projector. Flange 12 typically includes curved lip regions 26 at each comer of flange 12, the lip regions being configured to engage sockets in the interior housing. Alternatively, the lip regions may be polygonal, or of some other shape, or flange 12 may not include any lip regions.

Figure 2:
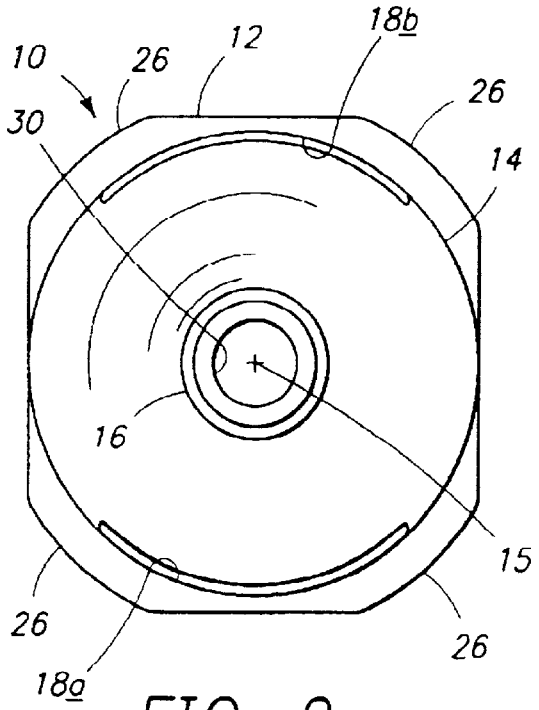
FIG. 2 is a top view of the reflector of FIG. 1.
Figure 3:
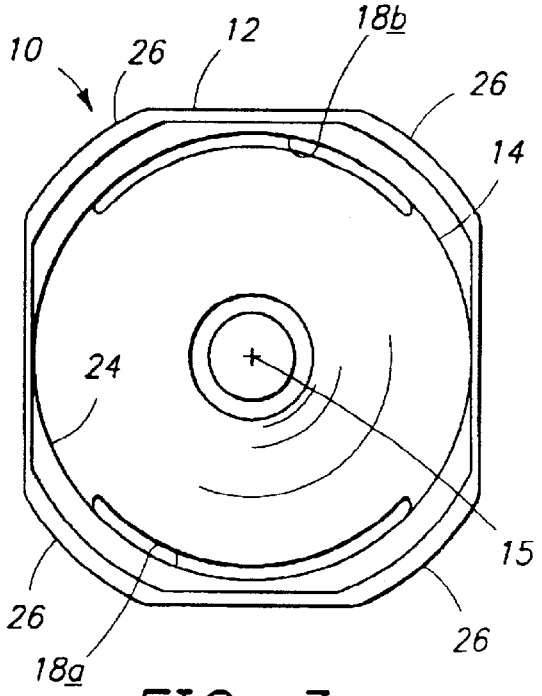
FIG. 3 is a bottom view of the reflector of FIG. 1.
Figure 1:
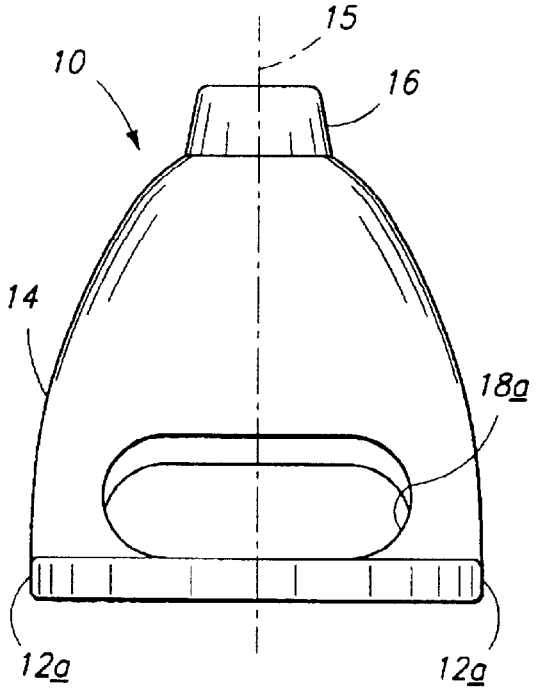
FIG. 1 is a front view of a reflector cut according to an embodiment of the present invention.

As can be seen in FIG. 1, flange 12 includes flush sides 12*a* viewed from the front. As shown in FIG. 4, flange 12 also includes projecting sides 12*b* viewed from the side. Alternatively, flange 12 may extend a uniform distance on all sides of enclosure 14, or may be of some other shape.

Typically, holes 18*a* and 18*b* are formed adjacent projecting sides 12*b* for increased strength. Alternatively, holes 18*a* and 18*b* may be positioned adjacent flush sides 12*a*, or at a distance from flange 12 in an interior region of enclosure 14, or at another predetermined location on reflector 10. Although holes 18*a* and 18*b* are described herein as ventilation holes, it will be appreciated that the holes may be for almost any purpose, and that the methods of the present invention may be used to cut virtually any type of hole in reflector 10.

Typically, enclosure 14 defines a shape of revolution formed around an axis of revolution 15, as shown in FIGS. 1 and 4. Enclosure 14 typically is substantially parabolic in shape and lamp 20 typically is positioned at the focal point of the parabola, such that light emitted from lamp 20 is reflected out opening 24 in parallel rays 28, as shown in FIG. 5. Alternatively, enclosure 14 may be a concavity of some other shape, such as a concavity having a hemispherical, hemiellipsoid, polygonal, or other predetermined cross-section, and may not be a surface of revolution. Lamp 20 typically is a metal halide lamp. However, virtually any other type of lamp, such as a tungsten lamp, may be used.

Interior surface 22 of enclosure 14 typically is coated with a reflective coating. Alternatively, the reflective coating may be placed on an exterior surface of enclosure 14, or may be embedded within the reflector itself. In addition, a protective coating typically is placed over the entire exterior and interior surfaces of the reflector. Alternatively, no such protective coating may be used.

Neck 16 typically extends upward from a top end of enclosure 14 and includes a thru-hole 30, through which lamp 20 may be inserted. As shown in FIG. 5, a cap 21 typically is positioned on the end of neck 16 and supports and holds lamp 20. Alternatively, lamp 20 and reflector 10 may be held within reflector 10 by external supports not requiring a cap 21. In addition, other holes and/or mounts may be placed on or in enclosure 14 further to aid in mounting lamp 20 within the interior of reflector 10. For example, a brace may pass through a hole on the reflector and be attached to a distal end of lamp 20 to support the lamp.

Ventilation holes 18*a*, 18*b* typically are cut in enclosure 14 to allow air to pass in and out of the interior of reflector 10, thereby cooling the interior of reflector 10. As used herein, the term "air" refers to any gas or combination of gases used to cool lamp 20 and reflector 10, whether atmospheric or otherwise. Holes 18*a*, 18*b* each include a chamfered or beveled perimeter edge 32, which aids in the direction of gases into and out of the enclosure. Typically, perimeter edge 32 is cut at an angle of inclination a between about 20 and 50 degrees inclined from a horizontal plane formed by flange 12. In a preferred embodiment of the invention, angle of inclination $\alpha$ is between about 30 and 35 degrees, and in a particularly preferred embodiment is about 32 degrees. Perimeter edge 32 also may be measured and cut at an angle $\beta$ of between about 40 and 70 degrees from axis of revolution 15. In a preferred embodiment, angle $\beta$ is between about 55 and 60 degrees, and in a particularly preferred embodiment is about 58 degrees. Edge 32 typically is flat. Alternatively, the surface of perimeter edge 32 may be concavely or convexly shaped.

Typically, holes 18*a*, 18*b* are positioned adjacent flange 12 in a region of enclosure 14 that is substantially vertical, as viewed in FIGS. 1–4. More light is reflected off the interior surface 22 per unit area at the base of the parabola, adjacent neck 16, than at the extreme reaches of the parabola, adjacent flange 12. Therefore, placing holes 18*a*, 18*b* adjacent flange 12 results in less interference in the reflectance of light from lamp 20 out of opening 24 than if the holes were positioned closer to neck 16. It should be understood, however, that holes 18*a*, 18*b* alternatively may be positioned adjacent neck 16, or at another predetermined location on enclosure 14 intermediate neck 16 and flange 12.

While holes 18*a*, 18*b* are shown as generally oval in shape, it will be appreciated that the holes may be virtually any shape that allows for passage of air into and out of reflector 10, such as circular, polygonal, or complexly curved. In addition, holes 18*a*, 18*b* alternatively may be larger or smaller than shown, depending on the cooling requirements of the lamp. While a pair of holes is shown, it will be understood that reflector 10 may include only a single ventilation hole, or more than two ventilation holes. For example, reflector 10 may include a perforated region having multiple ventilation holes to facilitate air flow into and out of the reflector, or may include holes on four opposed sides of the reflector, or in another predetermined configuration.

Figure 7:
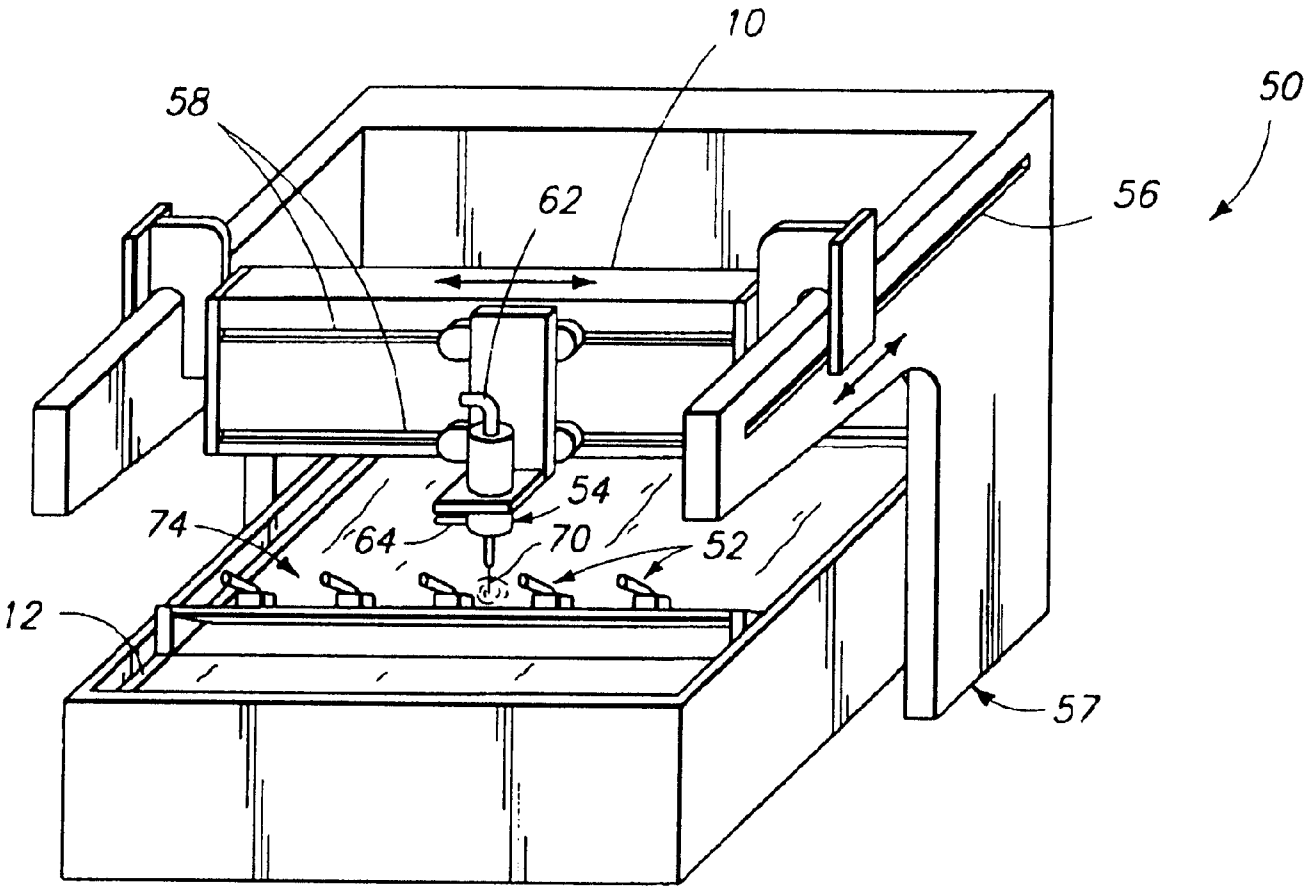
FIG. 7 is an isometric view of a fluid jet cutting machine according to an embodiment of the present invention.

Turning now to FIG. 7, a fluid jet cutting machine for use in accordance with one embodiment of the present invention is shown generally at 50. Fluid Jet cutting machine 50 may be the fluid jet cutting machine described in U.S. Pat. No. 5,273,405 to Chalmers, the disclosure of which is herein incorporated by reference, which machine is available commercially from Jet Edge, Inc., of Minneapolis, Minn. Fluid jet cutting machine 50 typically includes one or more jigs 52 for securely holding reflector 10, and a fluid jet nozzle 54 configured to be selectively positioned over each jig.

Although a two-axis fluid jet cutting machine is shown in FIG. 7, it will be appreciated that alternatively a fluid jet cutting machine with additional mobility may be used, such as a three-axis or five-axis fluid jet cutting machine. In addition, the jig may be configured to move and the nozzle to remain stationary, or both the jig and nozzle may be configured to move to achieve a desired cut path.

Nozzle 54 is configured to move front to rear along side tracks 56 positioned in frame 57, and left to right in lateral tracks 58 positioned in lateral guide 60. Typically, nozzle 54 is the cutting head described in U.S. Pat. No. 5,851,139, the disclosure of which is herein incorporated by reference, which is sold under the commercial name OMNIJET by Jet Edge, Inc. of Minneapolis, Minn. Alternatively, virtually any other suitable nozzle may be used.

Nozzle 54 is configured to receive a fluid through fluid supply line 62 and an abrasive material through abrasive supply line 64. Typically, the fluid is water and the abrasive material is 80-grit garnet. Alternatively, other suitable cutting fluids and additives may be used, and other types and/or sizes of abrasive may be used. The fluid and the abrasive are mixed and emitted at high pressure out of orifice 66 and tube 68, to form fluid jet 70. After being emitted from fluid jet nozzle 54, fluid jet 70 passes through reflector 10 and jig 52 into basin 72 of water 74.

As disclosed in U.S. Pat. No. 5,273,405 to Chalmers, fluid jet 70 is typically emitted from nozzle 54 at pressures ranging from 25,000 to 100,000 psi. According to the present invention, it has been found that a water jet cutting machine can be run for brief periods at pressures down to 5,000 psi and below, with careful maintenance and cleaning of the valves, mixing chamber, and other components of nozzle 54.

Jig 52 typically includes a frame 76 to which is attached a clamp 78 and a mounting plate 80. Frame 76 typically includes an L-shaped member 82 and a support plate 84 joined by a triangular block 86. The triangular block and L-shaped member combine to support mounting plate 80, clamp 78 and reflector 10 in an inclined orientation relative to the axis of nozzle 54. Alternatively, jig 52 may include a frame of another shape and may hold reflector 10 in another predetermined orientation.

Clamp 78 typically includes a handle 88 pivotably attached at one end to a pivot joint 90 on support block 92. Handle 88 is pivotably attached in an intermediate region to a first end of linkage member 94 at pivot joint 96. Linkage member 94, in turn, is attached pivotably at a second, opposite, end to shaft 100 at pivot joint 98. Shaft 100 is configured to slide up and down within shaft housing 102. Shaft housing 102 is rigidly mounted to support block 92.

Clamp 78 also typically includes a brace 103 attached to shaft 100 at a pivot joint 104. Brace 103 contacts the neck 16 of reflector 10 and holds reflector 10 against mounting plate 80. Brace 103 typically includes an L-shaped member 106 and a clamping pad 108 attached to a lower end of L-shaped member 106. Clamping pad 108 is typically rubber, although felt, plastic, metal, wood, or other material may also be used.

As handle 88 is rotated in a counterclockwise direction from the illustrated orientation, linkage member 94 causes shaft 100 to extend toward reflector 10, thereby clamping reflector 10 between clamping pad 108 and mounting plate 80. Alternatively, it will be understood that clamp 78 may be virtually any other type of clamp suitable to securely hold reflector 10 when cut by fluid jet cutting machine 50, such as a screw clamp, spring-biased clamp, or elastic straps.

Typically, jig 52 is configured to hold reflector 10 such that axis of revolution 15 is an angle $\beta$ away from the fluid jet 70, and the bottom surface of flange 12 is a corresponding angle a from fluid jet 70. Typically, $\beta$ is between about 40 and 70 degrees, and $\alpha$ is between about 20 and 50 degrees from axis of revolution 15. In a preferred embodiment, angle $\beta$ is between about 55 and 60 degrees and $\alpha$ is between about 30 and 35 degrees. In a particularly preferred embodiment $\beta$ is about 58 degrees and $\alpha$ is about 32 degrees.

Figure 9:
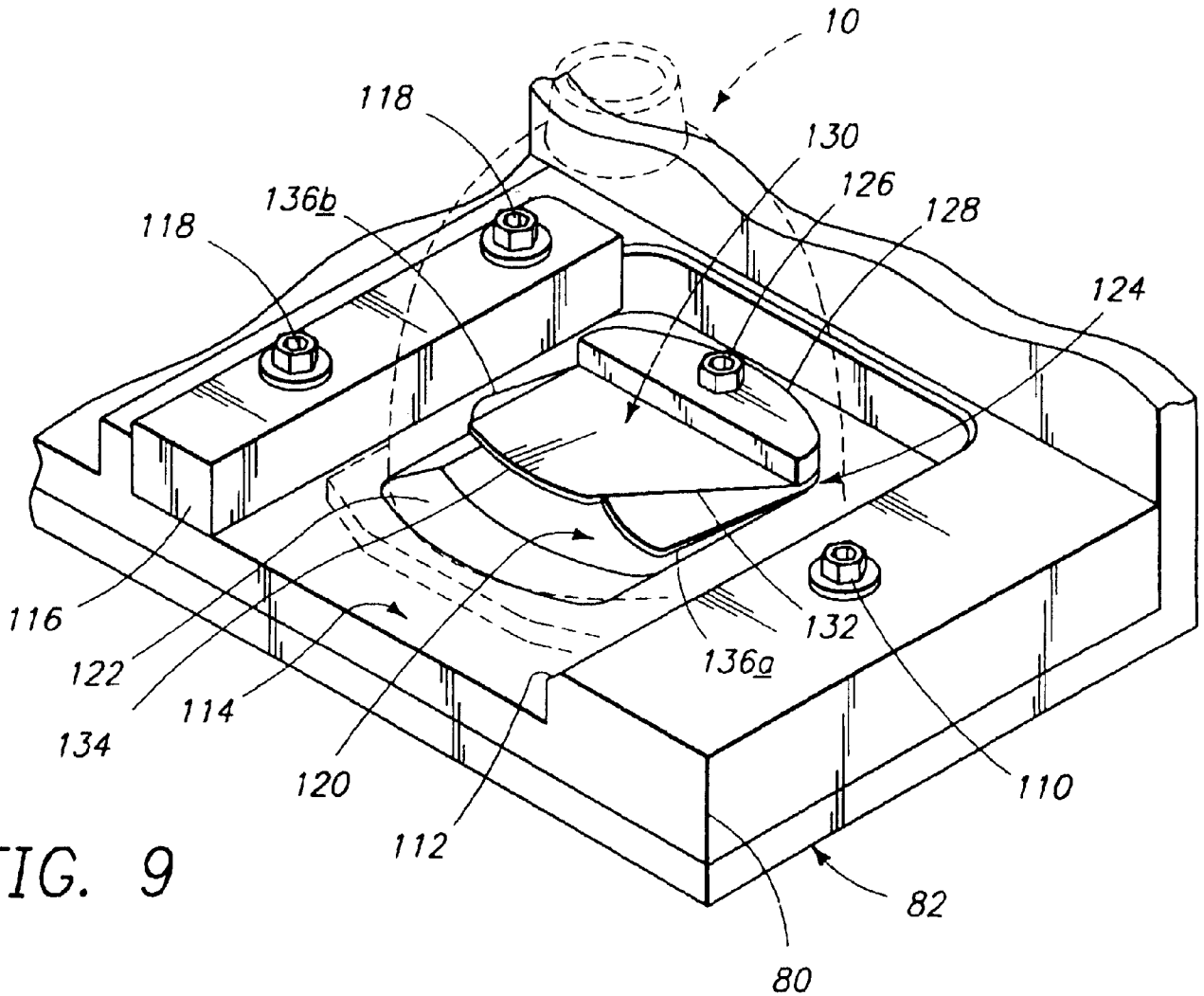
FIG. 9 is a detail isometric view of a portion of the jig of FIG. 8.

As shown in FIG. 9, mounting plate 80 typically is mounted to L-shaped bracket 82 by a fastener 110, such as a screw, bolt, or other fastener. Alternatively, mounting plate 80 and L-shaped bracket 82 may be welded together, or of unitary construction.

Mounting plate 80 typically includes a chamfered or beveled edge 112 extending around an inward side of the mounting plate. Mounting plate 80 also typically includes a well 114 configured to receive flange 12 of receptacle 10. Mounting plate 80 also typically includes a cushion 116 connected to the mounting plate by fasteners 118. Typically, cushion 116 is a strip of rubber. Alternatively, another suitable material, such as wood, plastic, or other resilient material may be used.

Well 114 typically includes a hole 120 extending from the top of mounting plate through mounting plate 80 and L-shaped bracket 82 to a bottom side of the L-shaped bracket. Typically, hole 120 includes a beveled or chamfered edge 122 around its upper perimeter. Alternatively, the edges of hole 120 may be straight, curved, or another shape. In operation, fluid jet 70 passes through hole 120 on its way to the water surface 74. It should also be understood that the mounting plate may be flat or convexly curved, and may not include a well.

Mounting plate 80 also typically includes a hood 124 mounted by fastener 126 to the mounting plate within well 114. Hood 124 typically includes an upwardly projecting lug portion 128 and an angled hood cover 130, including a flat top portion 132 with a curved lip 134. Cover 130 also typically includes side portions 136*a* and 136*b*. Alternatively, hood 124 may be of some other shape, such as continuously curved, and may not include side portions. Hood 124 is configured to inhibit glass, fluid, abrasive, and other contaminants from contacting the interior surface 22 of reflector 10 as fluid jet 70 is cutting holes 18*a* and 18*b*. Alternatively, jig 52 may not include any hood at all.

Figure 8:
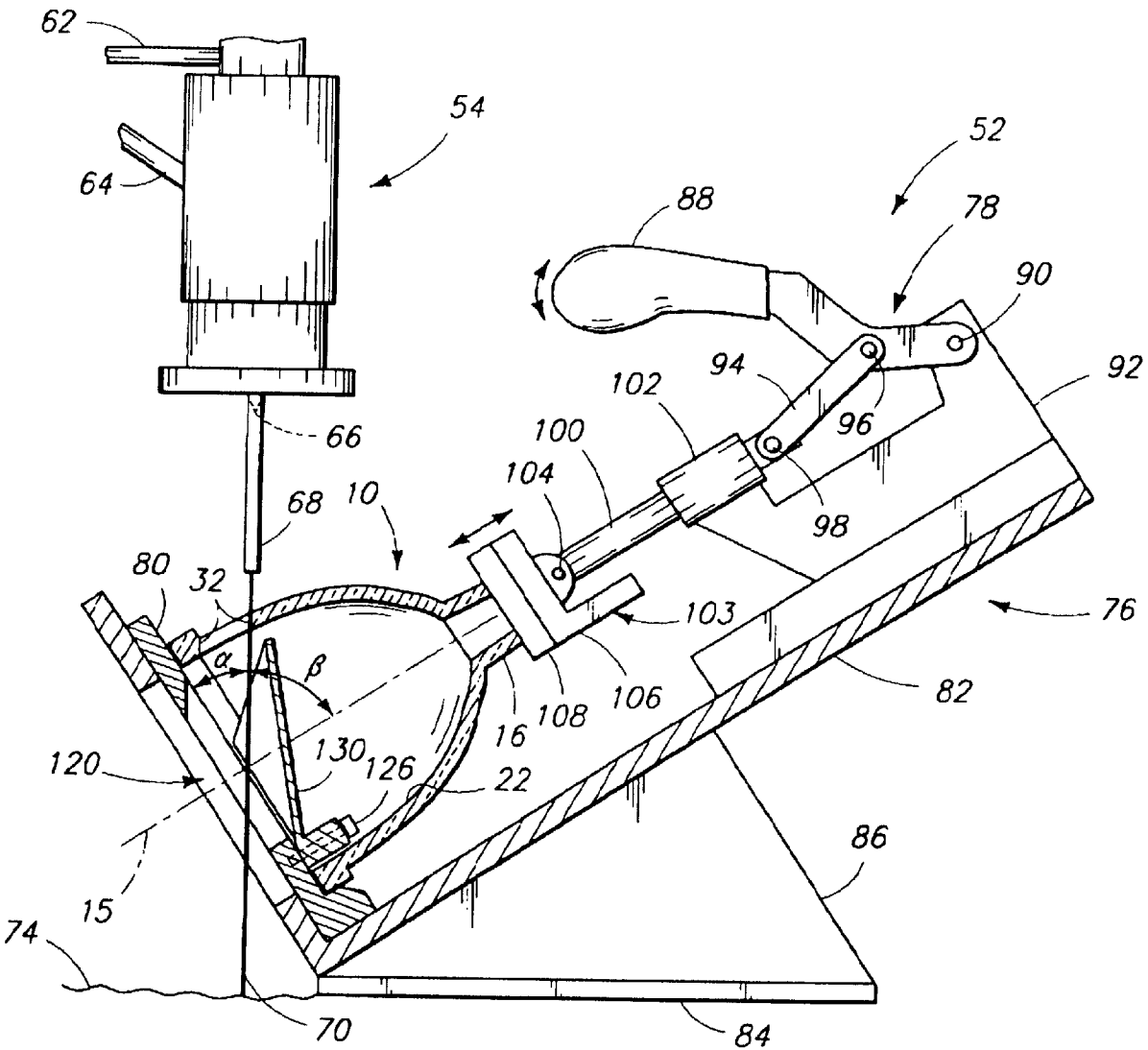
FIG. 8 is a partial cutaway side view of a jig of the fluid jet cutting machine of FIG. 7, with a reflector installed in the jig.
Figure 12:
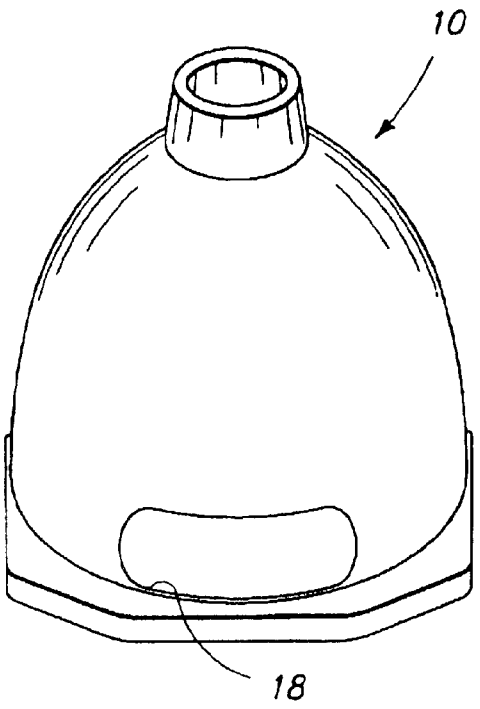
FIG. 12 is a top view of the inclined reflector of FIG. 8, showing a ventilation hole in the reflector.
Figure 11:
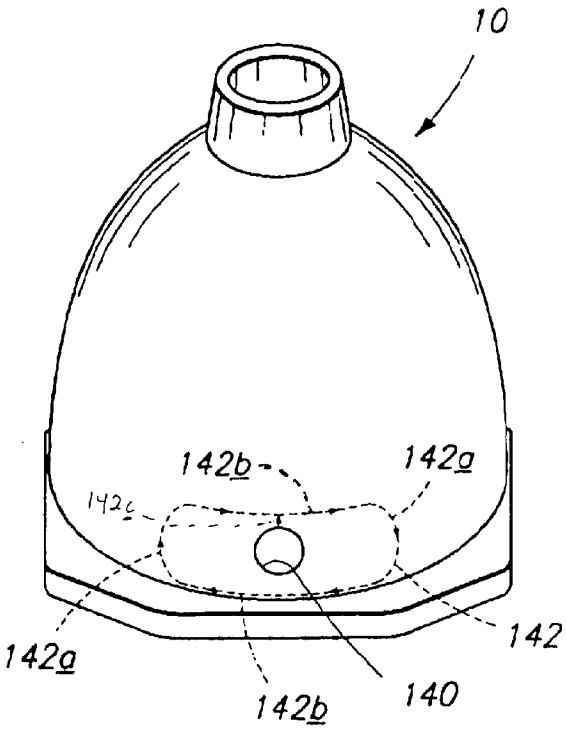
FIG. 11 is a top view of the inclined reflector of FIG. 8, showing a pierce hole and a circuitous ventilation-hole cutting path on the reflector.
Figure 10:
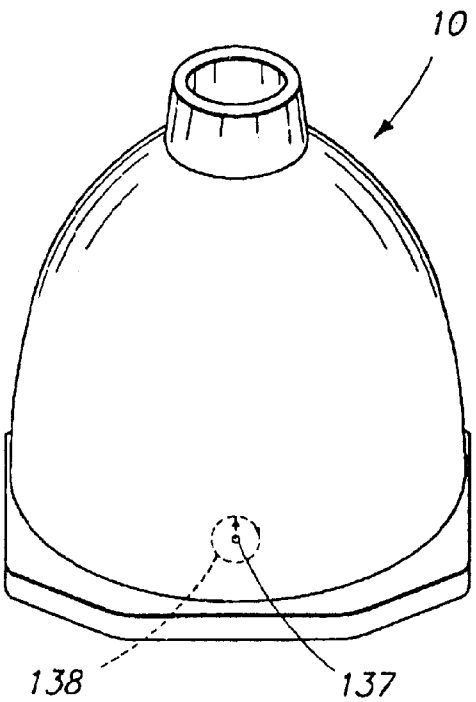
FIG. 10 is a top view of the inclined reflector of FIG. 8, showing a cutting path for a pierce hole on the reflector.

In each of FIGS. 10–12, reflector 10 is shown from a top view, the reflector being oriented at an upward angle as shown in FIG. 8. To form ventilation hole 18, fluid jet 70 typically is adjusted to an initial pressure and initial fluid flow rate and abrasive flow rate. At the initial pressure and flow rates the fluid jet is used to penetrate a wall of glass reflector 10 and form an initial thru-hole 137. Typically, the initial pressure is less than 10,000 psi. In one preferred embodiment of the invention, the initial pressure is between about 3,000 and 7,000 psi. In a particularly preferred embodiment of the invention, the initial pressure is about 5,000 psi. It should also be understood that this low initial pressure typically is outside the recommended operating parameters of the water jet cutting machine. At such a low pressure, the nozzle of the water-jet cutting machine often clogs with abrasives and the flow-actuated valves of the machine often stick. However, according to the present invention, it has been discovered that the water-jet cutting machine can be run briefly at low pressures if maintained and cleaned often and meticulously.

Typically, the initial abrasive flow rate is less than about 3.5 ounces per minute. In one preferred embodiment of the invention, the initial abrasive flow rate is between about 2 and 3 ounces per minutes, and in a particularly preferred embodiment of the invention, is about 2.5 ounces per minute. The initial fluid flow rate typically is substantially less than 0.39 gallons per minute. Cutting the initial thru-hole at the initial pressure avoids the problem commonly experienced at higher pressures of fracturing and shattering the glass upon impact.

From the initial thru-hole 137, fluid jet 70 is moved to cut an initial circuitous pierce-hole path 138 to form a pierce hole 140. The initial circuitous pierce-hole path is shown enlarged for clarity in FIG. 10. Typically, the initial circuitous pierce-hole path is a circle of a substantially small diameter, as cutting at the initial pressure is relatively slow compared to cutting at increased pressures, and it is desirable to cut the ventilation hole as quickly as possible to reduce part costs.

Typically, the diameter of the initial circuitous pierce hole path is less than about 0.25 inches. In one preferred embodiment of the invention, the diameter of the circuitous pierce hole path is between about 0.05 and 0.15 inches, and in a particularly preferred embodiment is about 0.1 inches. In another preferred embodiment of the invention, pierce hole 140 is formed only by cutting the initial through-hole 137, and the fluid jet is not moved around the initial circuitous pierce hole path. In this embodiment, the diameter of the pierce hole is substantially the same as the diameter of the initial through hole, typically 0.03 inches. Alternatively, virtually any other size and shape of pierce hole may be used, such as an oval or polygonal hole.

Typically, fluid jet 70 is moved along the initial circuitous pierce hole path at a pierce hole feed rate of less than about 8 inches per minute. In one preferred embodiment of the invention, the pierce hole feed rate is between about 3 and 6 inches per minute, and in a particularly preferred embodiment is about 4.5 inches per minute. These values for the pierce hole feed rate typically are used when the wall of the reflector is approximately one-eighth of an inch thick. Alternatively, the pierce hole feed rate may be faster or slower to accommodate different thicknesses of enclosure 14, and/or to vary the quality of the cut in the reflector.

Typically, the fluid jet cutting machine 50 is also configured to cut along a second circuitous ventilation-hole path 142 at an increased pressure, increased fluid flow rate, and increased abrasive flow rate. Typically, the increased pressure is above about 25,000 psi. In a preferred embodiment of the invention, the increased pressure is between about 30,000 and 55,000 psi. In a particularly preferred embodiment of the invention, the increased pressure is about 35,000 psi. The increased fluid flow rate typically is greater than 0.25 gallons per minute. In one preferred embodiment of the invention, the increased fluid flow rate is between about 0.30 and 0.50 gallons per minute, and in a particularly preferred embodiment, is about 0.39 gallons per minute. Typically, the increased abrasive flow rate is above about 3.5 ounces per minute. In one preferred embodiment of the invention, the increased abrasive flow rate is between about 3.5 and 5 ounces per minute, and in a particularly preferred embodiment is about 4 ounces per minute.

At the increased pressure, fluid jet 70 is moved around second circuitous ventilation-hole path 142 to produce ventilation hole 18. Second circuitous ventilation-hole path 142 typically surrounds pierce hole 140, and the ventilation hole 18 is cut around the pierce hole. This is achieved by moving the water jet from the edge of pierce hole 140 to ventilation hole path 142 along an intermediate path 142*c*. Alternatively, second circuitous ventilation-hole path 142 may intersect hole 140, such that ventilation hole 18 is cut adjacent and partially intersecting pierce hole 140. In addition, fluid jet 70 alternatively may cut a circuitous ventilation-hole path forming the boundary of hole 18 directly from the initial thru-hole 137, without cutting an initial circuitous pierce-hole path 138.

To form an oval ventilation hole, as shown at 18*a* in FIG. 1, when the reflector is mounted at an angle in jig 52, the fluid jet typically moves along a circuitous ventilation-hole path that is the projection of an oval onto the sloping parabola of the reflector 10. This projection produces a circuitous ventilation-hole path with rounded sides 142*a* and upwardly turned top and bottom regions 142*b*. Many other circuitous ventilation-hole paths alternatively may be used.

Fluid jet 70 typically is moved along second circuitous ventilation-hole path 142 at a ventilation-hole feed rate of above about 15 inches per minute. In one preferred embodiment of the invention, the ventilation-hole feed rate is between 20 and 25 inches per minute and, in a particularly preferred embodiment, is about 22.5 inches per minute. Alternatively, a faster or slower ventilation-hole feed rate may be used on the second circuitous ventilation hole path to accommodate varying thicknesses in the reflector wall, and/or to achieve a clean and straight cut. For example, because fluid jets tend to cut more efficiently adjacent the impact of the fluid jet and the work piece, fluid jets may cut a noticeably slanted or angled cut where the work piece is thick or the feed rate is high. Therefore, it may be desirable to adjust the pierce-hole feed rate and/or ventilation-hole feed rate to achieve a straight and clean cut.

Typically, hood 124 and opening 120 are configured to be large enough that sections of the glass reflector circumscribed and removed by cutting the circuitous pierce-hole path and circuitous ventilation-hole path may fall through hood 124 and opening 120 to water 74.

FIGS. 10–12 illustrate the cutting of ventilation hole 18 on one side of reflector 10. It will be understand that, to cut ventilation holes 18*a* and 18*b*, as illustrated in FIGS. 1–4, first, ventilation hole 18*a* is cut in reflector 10 as illustrated in FIG. 8 and, subsequently, the reflector is removed from jig 52, rotated 180-degrees, and reinstalled in jig 52 in an orientation such that hole 18*b* can be cut on an opposite side of the reflector. Alternatively, reflector 10 may be rotated only 90-degrees or some other predetermined angle, or positioned in another configuration in jig 52 such that additional holes may be cut at other predetermined locations on reflector 10. In addition, jig 52 may be configured to rotate reflector 10 automatically for the cutting of each of the ventilation holes.

Figure 13:
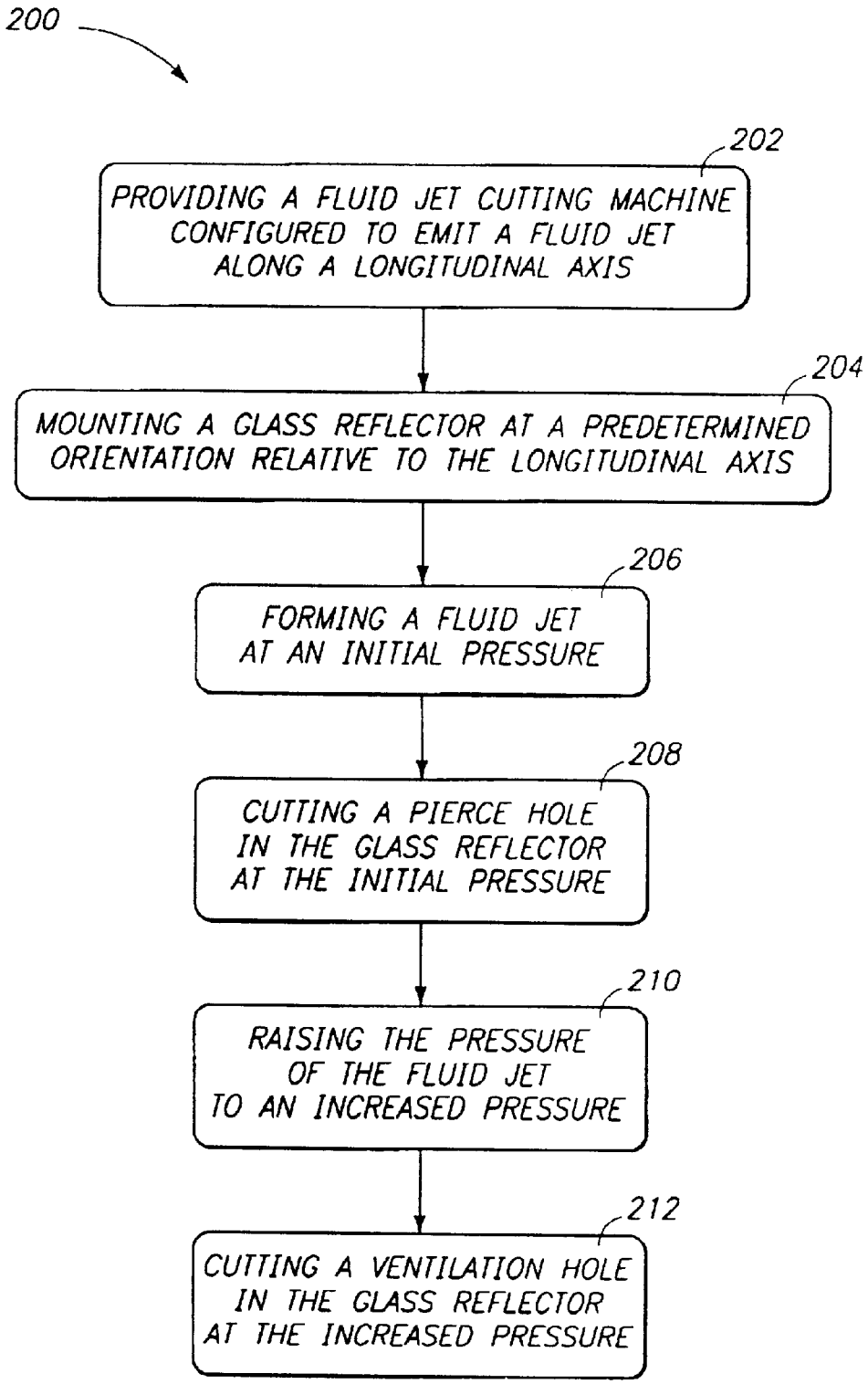
FIG. 13 is a flowchart of a method for forming a hole in a glass reflector according to an embodiment of the present invention.

Referring now to FIG. 13, a method of cutting a glass reflector according to the present invention is shown generally at 200. At 202, the method typically includes providing a fluid jet cutting machine configured to emit a fluid jet along a longitudinal axis.

At 204, the method typically includes mounting the reflector at a predetermined orientation relative to the longitudinal axis of the fluid jet. Typically, the reflector is mounted at an angle in a jig such that the fluid jet will cut a wall of the reflector at an angle, as described above, and pass through the reflector and jig into a water basin.

At 206, the method typically includes forming a fluid jet by ejecting a mixture of fluid and an abrasive at an initial pressure. Typically, the fluid is water. Alternatively, a fluid other than water may be used. The method may also include forming the fluid jet at an initial fluid flow rate and an initial abrasive flow rate. Values for the initial pressure and initial fluid flow rate and abrasive flow rate are described above.

At 208, the method typically includes cutting or creating a pierce hole in the glass reflector, with the fluid jet at the initial pressure. Typically, the pierce hole is cut by penetrating a wall of the glass reflector with the fluid jet to form a initial thru-hole and enlarging the thru-hole by cutting along an initial circuitous pierce-hole cutting path, as shown in FIG. 10 and described above. Alternatively, the initial thru-hole may not be enlarged.

Typically, the pierce hole is substantially circular in shape, and has dimensions as described above. Alternatively, the pierce hole may be rounded, square, polygonal, or virtually any other shape. The fluid jet is moved along the initial circuitous pierce-hole cutting path at a predetermined pierce-hole feed rate. Typical values for the pierce-hole feed rate are described above.

At 210, the method typically includes raising the pressure of the fluid jet from the initial pressure to an increased pressure. The method also may include raising the initial fluid flow rate and initial abrasive flow rate to an increased fluid flow rate and increased abrasive flow rate. Typical values for the increased pressure, increased fluid flow rate, and increased abrasive flow rate are described above.

At 212, the method typically includes cutting a ventilation hole in the glass reflector at the increased pressure. This typically is accomplished by moving the fluid jet outward from the pierce hole and causing the fluid jet to traverse a circuitous ventilation-hole cutting path, as shown in FIG. 11. The fluid jet typically is moved along the circuitous ventilation-hole cutting path at a predetermined ventilation-hole feed rate, values for which are described above.

It will be understood that method 200 may be repeated to form multiple ventilation holes in reflector 10.

Figure 6:
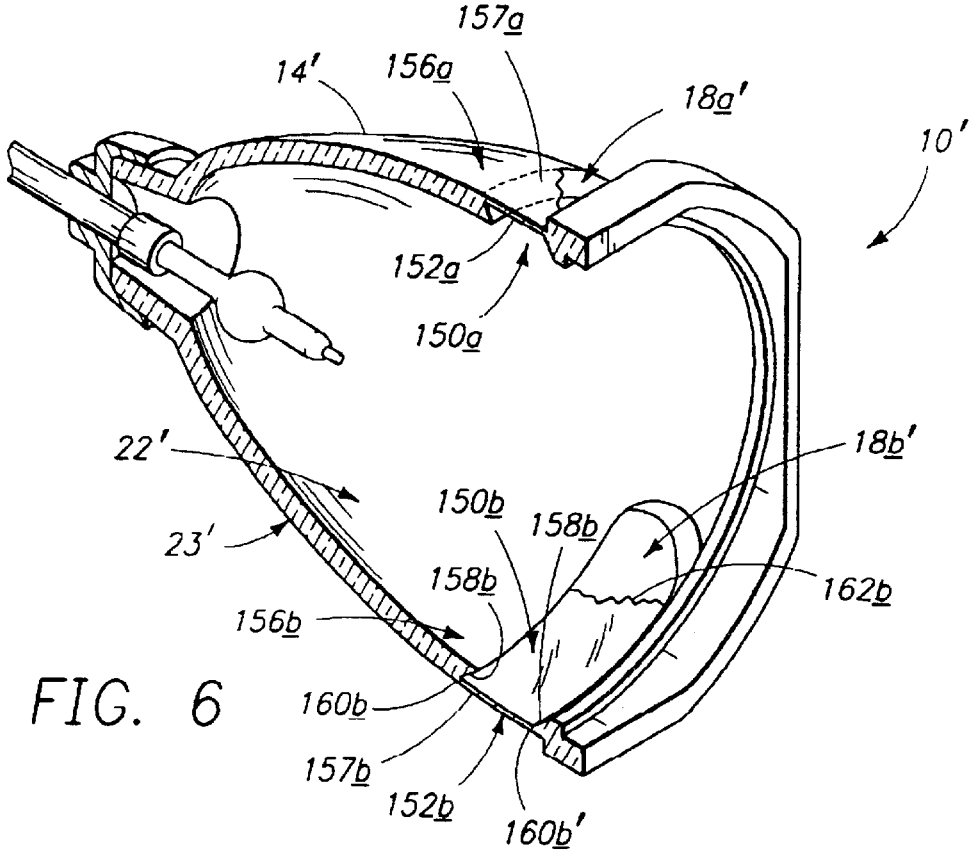
FIG. 6 is a cutaway isometric view of a reflector formed according to another embodiment of the present invention, with a lamp installed.

Turning now to FIG. 6, another embodiment of a reflector according to the present invention is shown generally at 10'. Reflector 10' includes depressions 150*a* and 150*b*, each including a respective bridge or bottom portion 152*a* and 152*b*. Typically, bridge portions 152*a* and 152*b* are thin walls, substantially thinner than surrounding wall regions 156*a* and 156*b* of enclosure 14' of reflector 10'. The bridge portions separate the bottom of the depressions from a respective opposite surface 157*a*, 157*b* of the enclosure 14'.

The bridge portions 152*a* and 152*b* are configured to be removed to form respective holes 18*a*' and 18*b*' in reflector 10'. Depression 150*b* typically is bounded by an edge 158*b*. To form hole 18*b*' , bridge portion 152*b* is configured to break along boundary 160*b*, adjacent edge 158*b*, upon impact of bridge portion 152*b* and a breaking tool. Jagged line 162*b* shows bridge portion 152*b* partially broken to reveal a portion of hole 18*b*'. Depression 150*a* typically is symmetric to depression 150*b*, and hole 18*a*' is formed therefrom in a similar manner.

Typically, the depressions are molded into an interior surface 22' of the enclosure. Alternatively, the depressions may be molded into an exterior surface 23' of the enclosure. Typically, the bridge portion is formed flush with an exterior surface 23' of the enclosure. Alternatively, the bridge portion may be formed flush with the interior surface 22' of the enclosure, or may be formed intermediate the exterior and interior surfaces of the enclosure, or protruding from either the exterior or interior surface of the enclosure. Typically, the bridge portion is formed with a uniform thickness. Alternatively, the bridge portion may vary in thickness, for example, the bridge portion may become thinner adjacent its edges, or may be thicker in a middle section.

Figure 14:
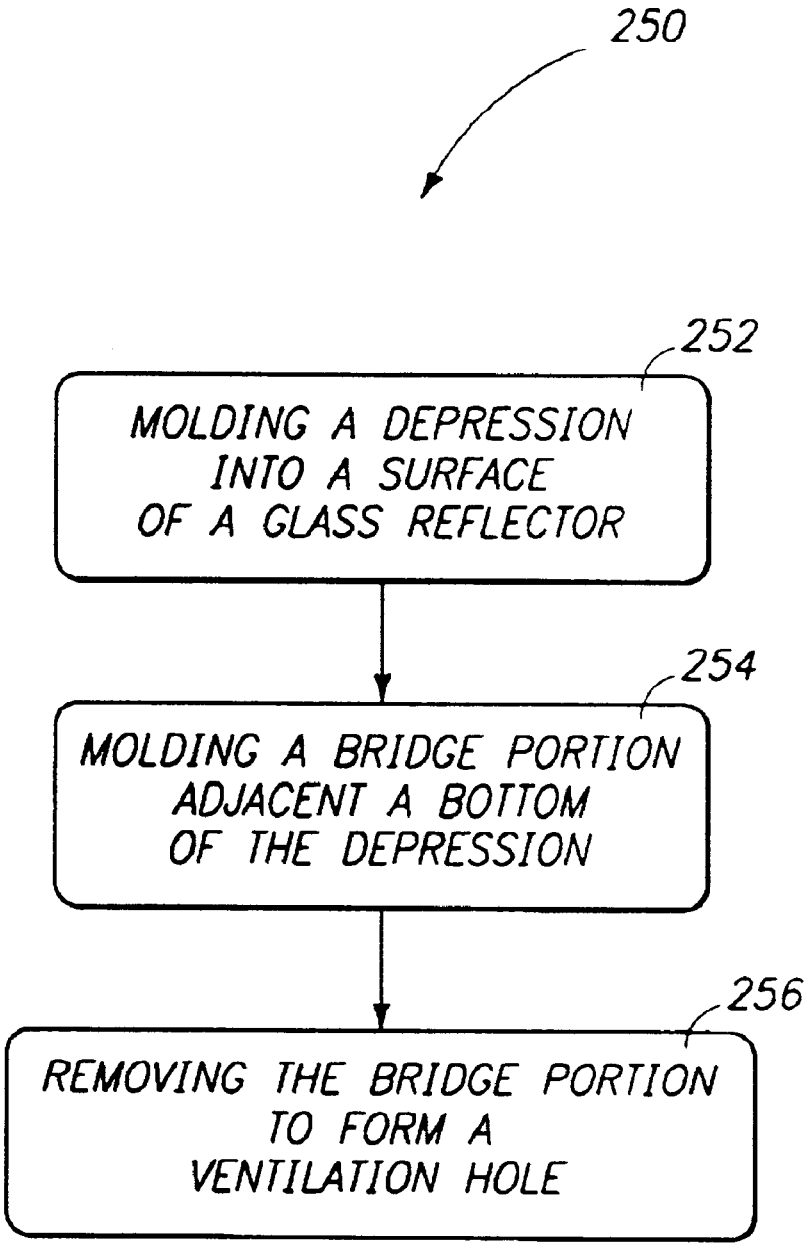
FIG. 14 is a flowchart of a method for forming a hole in a glass reflector according to another embodiment of the present invention.

Turning now to FIG. 14, another embodiment of a method according to the present invention for forming a hole in a glass reflector is shown generally at 250. At 252, the method includes molding a depression into a surface of the glass reflector. Typically, the depression is molded in a wall of an enclosure of the glass reflector, and includes a bottom and a perimeter having opposed edge portions, shown at 160*b* and 160*b*' in FIG. 6.

Typically, the depression is molded using a two-part mold equipped with sliders, which disengage the depressions before the mold is separated. Alternatively, other molding technologies may be employed to form the depression. Typically, the depression is formed in the interior surface 22' of the enclosure, as described above. Alternatively, the depression may be formed in the exterior surface 23' of the enclosure. In addition, an outer depression may be formed on the exterior surface and an inner depression on the interior surface, the inner and outer depressions being separated by a bridge portion.

At 254, the method also includes molding a bridge portion between the opposed edge portions, adjacent a bottom of the depression. The bridge portion separates the bottom of the depression from an opposite surface of the glass reflector. Typically, the bridge portion is formed flush with the exterior surface 23' of the enclosure and the depression opens to the interior surface 22' of the enclosure. Alternatively, the bridge portion may be formed flush with the interior surface 22' of the enclosure and the depression may open to the exterior surface 23' of the enclosure. In addition the bridge portion may be recessed from both the interior and exterior surfaces, or protruding from either the interior and/or exterior surface of the enclosure.

At 256, the method includes removing the bridge portion to form a ventilation hole in the glass reflector. Typically, the bridge portion is removed by mechanical action, such as a piston or ram that punches out the bridge portion. Alternatively the bridge portion may be cut by a fluid jet, as described above, or by a saw, lathe, milling machine, drill, grinder, compressed air, laser, or other cutting, punching, or abrasive process. Typically, the bridge portion is removed by cutting or breaking the wall along the edge of the bridge portion. The resulting hole is configured to allow air to pass into and out of the enclosure, to cool the interior of the enclosure.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims are also regarded as included within the subject matter of the present invention irrespective of whether they are broader, narrower, or equal in scope to the original claims.

We claim:

1. A method for cutting a glass reflector, the method comprising:

forming a fluid jet by ejecting a mixture of fluid and abrasive at an initial pressure between about 3,000 and 7,000 psi;

creating a pierce hole in the glass reflector with the fluid jet at the initial pressure; and cutting a ventilation hole in the glass reflector by moving the fluid jet from the pierce hole along a cutting path.

2. The method of claim 1, where the initial pressure is about 5,000 psi.

3. The method of claim 1, further comprising:

after cutting the pierce hole and before cutting the ventilation hole, raising the pressure of the fluid jet from the initial pressure to an increased pressure.

4. The method of claim 3, where the increased pressure is above about 25,000 psi.

5. The method of claim 3, where the increased pressure is between about 30,000 and 55,000 psi.

6. The method of claim 3 where the increased pressure is about 35,000 psi.

7. The method of claim 1, where cutting the pierce hole includes penetrating a wall of the glass reflector with the fluid jet to form a thru-hole, and enlarging the pierce hole.

8. The method of claim 7, where enlarging the pierce hole includes moving the fluid jet from the initial thru-hole to cut along a circuitous pierce-hole cutting path.

9. The method of claim 7, where the pierce hole has a diameter of less than about 0.25 inches.

10. The method of claim 7, where the fluid jet is moved along the circuitous pierce hole cutting path at a pierce hole feed rate of below about 8 inches per minute.

11. The method of claim 7, where the fluid jet is moved along the circuitous pierce hole cutting path at a pierce hole feed rate of between about 3 and 6 inches per minute.

12. The method of claim 7, where the fluid jet includes an initial abrasive flow rate of less than about 3.5 ounces per minute.

13. The method of claim 7, where the fluid jet includes an initial abrasive flow rate of between about 2 and 3 ounces per minute.

14. The method of claim 1, where cutting the ventilation hole includes moving the fluid jet from the pierce hole to cut along a circuitous ventilation hole cutting path.

15. The method of claim 14, where the fluid jet is moved along the circuitous ventilation hole cutting path at a ventilation hole feed rate of above about 15 inches per minute.

16. The method of claim 14, where the fluid jet is moved along the circuitous ventilation hole cutting path at a ventilation hole feed rate of between about 20 and 25 inches per minute.

17. The method of claim 14, where the ventilation hole is cut at an increased abrasive flow rate of greater than about 3.5 ounces per minute.

18. The method of claim 14, where the ventilation hole is cut at an increased abrasive flow rate of between about 3.5 and 5 ounces per minute.

19. The method of claim 14, where the ventilation hole is cut at an increased fluid flow rate of greater than about 0.25 gallons per minute.

20. The method of claim 14, where the ventilation hole is cut at an increased fluid flow rate of between about 0.30 and 0.50 gallons per minute.

21. The method of claim 1, where the ventilation hole is round.

22. The method of claim 1, where the ventilation hole is cut adjacent the pierce hole.

23. The method of claim 1, where the ventilation hole is cut around the pierce hole.

24. The method of claim 1, further comprising: mounting the glass reflector at an angle relative to a longitudinal axis of the fluid jet.

25. The method of claim 1, where cutting the pierce hole includes cutting the pierce hole with an edge angled relative to an outer surface of the glass reflector.

26. The method of claim 1, where the reflector includes an axis of revolution, and cutting the pierce hole includes cutting the pierce hole with an edge angled relative to the axis of revolution.

27. A glass reflector for a bulb assembly, the glass reflector being formed by a process comprising:

forming a fluid jet by ejecting a mixture of fluid and abrasive at an initial pressure between about 3,000 and 7,000 psi;

cutting a first hole in the glass reflector with the fluid jet at the initial pressure;

raising the pressure of the fluid jet from the initial pressure to an increased pressure; and cutting a second hole in the glass reflector by moving the fluid jet from the first hole along a circuitous cutting path.

28. A method of forming a ventilation hole in a glass reflector, comprising:

molding a depression into a wall of the glass reflector, the depression including a bottom, and a perimeter having opposed edge portions;

molding a bridge portion between the opposed edge portions, adjacent the bottom of the depression; and removing the bridge portion to form the ventilation hole in the glass reflector.

* * * * *